United States Patent [19]

Suski

[11] Patent Number: 4,759,337

[45] Date of Patent: Jul. 26, 1988

[54] BOW WITH OPTIMUM DEPTH PERCEPTION AND VISIBILITY ENHANCING SIGHT WINDOW

[76] Inventor: Michael R. Suski, 313 N. Elms Rd., Flushing, Mich. 48433

[21] Appl. No.: 746,504

[22] Filed: Jun. 19, 1985

[51] Int. Cl.[4] ..... F41B 5/00

[52] U.S. Cl. ..... 124/24 R; 124/41 A; 124/88

[58] Field of Search ..... 124/23 R, 24 R, 41 R, 124/41 A, 25, 87, 86, 88, 35; 33/265

[56] References Cited

U.S. PATENT DOCUMENTS

| | | | |
|---|---|---|---|
| 1,847,593 | 3/1932 | Cameron | 124/24 R |
| 1,926,845 | 1/1932 | Folberth et al. | 124/24 R |
| 2,186,386 | 1/1940 | Lowell | 124/24 R |
| 2,642,661 | 6/1953 | Fredrickson | 124/24 R |
| 2,909,167 | 10/1959 | Fredrickson | 124/24 R |
| 3,406,675 | 10/1968 | Fredrickson | 124/24 R |
| 4,236,497 | 12/1980 | Troncoso | 124/41 A |
| 4,372,282 | 2/1983 | Sanders | 124/24 R |

*Primary Examiner*—Richard C. Pinkham
*Assistant Examiner*—Gary Jackson
*Attorney, Agent, or Firm*—Fleit, Jacobson, Cohn & Price

[57] ABSTRACT

A bow is provided including a rigid central portion and opposite end flexive limbs. The central portion defines a handgrip extending longitudinally of the central portion and a sight window spaced slightly from the handgrip bound by peripheral thin plate portions supporting the corresponding limb from the handgrip. The window is elongated longitudinally of the central portion and gradually tapers in width toward the corresponding limb and more sharply tapers in width toward the handgrip. The window is provided with an arrow rest incorporating a central post and at least one transverse rod including an outer end mounted for adjustable longitudinal shifting and an inner end closely adjacent and to one side of the upper end of the post. The adjacent ends of the post and rod include hair tufts for engaging an arrow in the rest position.

11 Claims, 2 Drawing Sheets

BOW WITH OPTIMUM DEPTH PERCEPTION AND VISIBILITY ENHANCING SIGHT WINDOW

BACKGROUND OF THE INVENTION

1. Field of the Invention

This invention relates to a bow and more specifically to a bow incorporating a sight window of a size and configuration to greatly enhance depth perception and visibility of a target viewed through the window. The invention also incorporates a novel arrow rest within a lower portion of the window and the rest is of the convertible type enabling the bow to be used by both right- and left-handed archers. In addition, the bow is constructed in a manner whereby a sight window is provided both above and below the hand-grip so that even a compound bow may be quickly converted for use by either a right-handed archer or a left-handed archer.

2. Description of Related Art

Various different forms of sight windows and arrow rests heretofore have been provided such as those disclosed in U.S. Pat. Nos. 1,847,593, 2,186,386, 2,918,049, 3,491,739, 3,561,418, 3,834,368 and 4,236,497. However, these previously known forms of sight windows and arrow rests do not include the overall structural features of the instant invention nor are they specifically designed to provide optimum depth perception and visibility through the associated sight windows.

SUMMARY OF THE INVENTION

The bow of the instant invention includes a central elongated and stiff mid-portion and a pair of elongated flexive limbs projecting endwise outwardly from the opposite ends of the mid-portion. The mid-portion includes a vertically invertible handgrip defined between lateral enlargements providing abutment surfaces and the handgrip is spaced between a pair of large sight windows defined by the opposite ends of the mid-portion. Each of the sight windows includes, when that sight window is uppermost, upwardly convergent upper side marginal edges whose upper ends are spaced apart and downwardly convergent lower side marginal edges. Arrow rest structure is provided for mounting in either window in general horizontal registry with the maximum width portion of that window that the arrow rest structure is adaptable for use by either right- or left-handed archers.

The portions of the opposite ends of the longitudinal mid-portion of the bow which define the sight windows are comprised of thin plate portions extending in front-to-rear directions and these plate portions are between $\frac{1}{8}$ inch and $\frac{1}{4}$ inch in thickness. Accordingly, an archer may not only view the target through a selected window, but may also clearly view the full field of view about the target area, except for those portions of the field of view occupied by the thin plate portions of the bow defining the sight window thereof being used.

The main object of this invention is to provide an improved bow construction including a sight window which will function to enhance the depth perception and visibility of a target viewed through the window.

Another object of this invention is to provide an improved arrow rest for use in the sight window and which may be adjusted for use by either a right-handed archer or a left-handed archer.

Yet another object of this invention is to provide a bow with an improved vertically invertible handgrip.

Still another important object of this invention is to provide a bow with a handgrip designed to maintain the archer's hand engaged therewith approximately $2\frac{1}{4}$ inches below the rest position of an arrow engaged with the arrow rest.

A further object of this invention is to provide a handgrip and sight window construction for a compound bow enabling the compound bow to be inverted for use by either a right-handed archer or a left-handed archer.

Another object of this invention is to provide a sight window and attendant arrow rest construction which will enable the use of arrows having larger fletching structure thereon.

A further object of this invention is to provide an archery bow sight window and rest combination which will eliminate "twisting torque" such as that caused by off-center sight windows.

Another important object of this invention is to provide an arrow rest utilizing mohair bristle tips as rest portions for an associated arrow.

A final object of this invention to be specifically enumerated herein is to provide an improved bow in accordance with the preceding objects and which will conform to conventional forms of manufacture, be of simple construction and easy to use so as to provide a device which will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
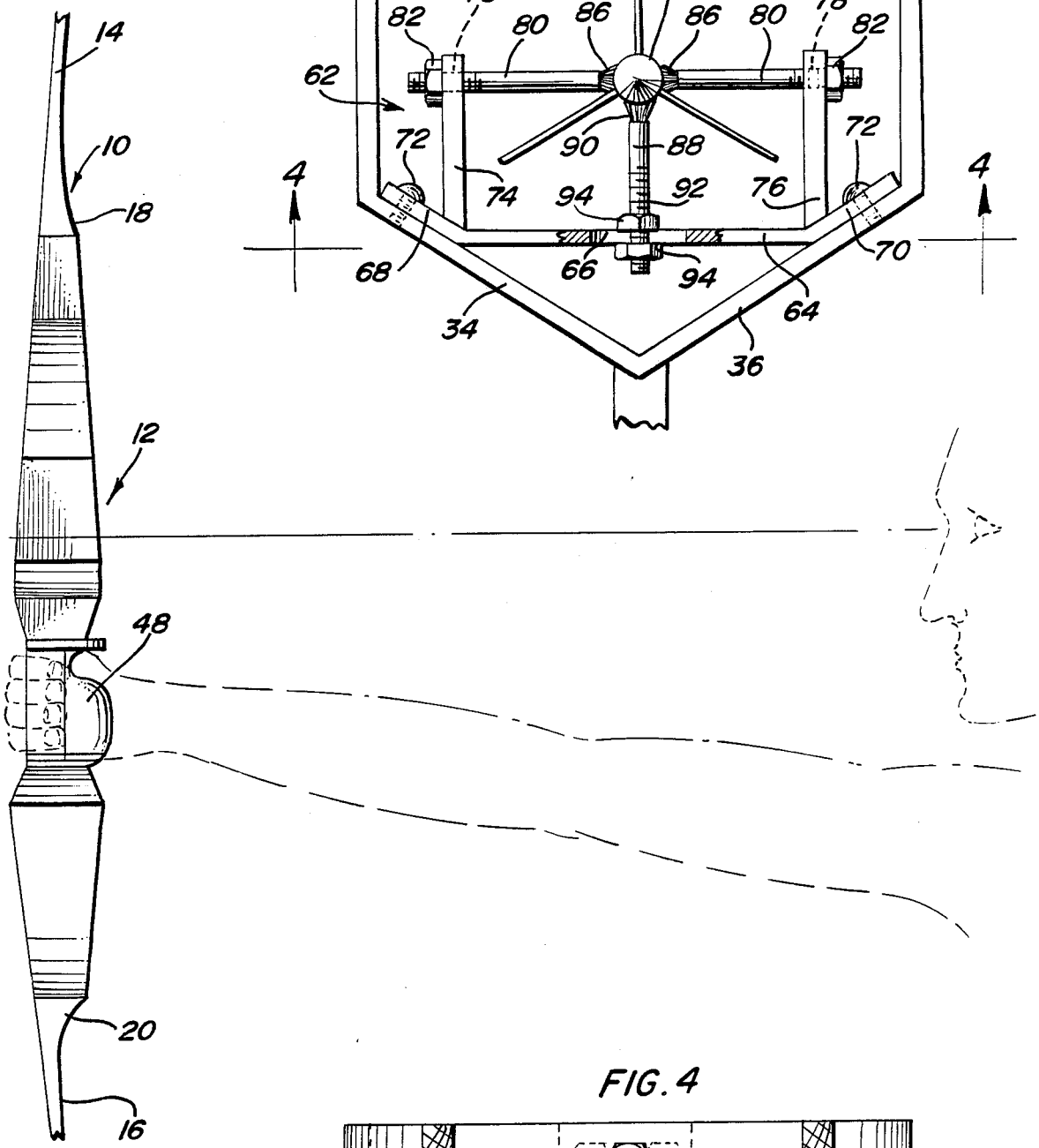
FIG. 1 is a fragmentary side elevational view of a bow constructed in accordance with the present invention.

Referring now more specifically to the drawings, the numeral 10 generally designates a bow constructed in accordance with the present invention and including a vertically elongated mid-portion 12 and a pair of elongated limbs 14 and 16 having their base ends 18 and 20 mounted from the opposite ends of the mid-portion 12 and their free ends (not shown) extending endwise outwardly from the corresponding ends of the mid-portion 12.

The bow 10, as illustrated, comprises a conventional bow. However, the bow 10 could comprise a compound bow as will be hereinafter more fully set forth.

The mid-portion 12 may be variously constructed, but it is proposed that the mid-portion 12 will be constructed of lightweight metal*, either cast or fabricated, and the limbs 14 and 16 may be joined to the mid-portion 12 in any convenient manner.

*Fiberglass, plastic and or combination, or graphite.

Figure 2:
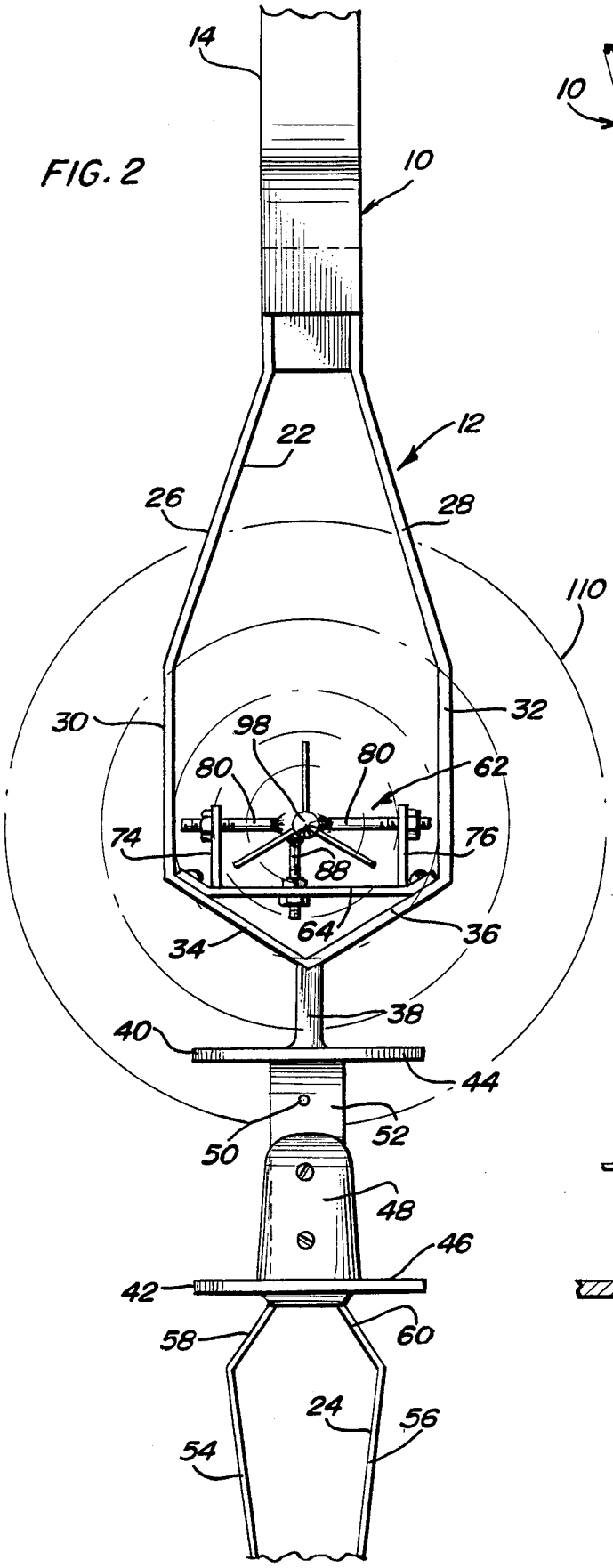
FIG. 2 is a fragmentary enlarged rear elevational view of the mid-portion of the bow illustrating the two relatively inverted and different size sight windows thereof, the vertically invertible handgrip and the arrow rest of the instant invention mounted within the upper side window of the bow and in use supporting an arrow in a rest position therefrom.

With reference now more specifically to FIG. 2 of the drawings, it may be seen that the mid-portion 12 defines upper and lower sight window openings 22 and 24. The window or opening 22 is defined by a pair of upwardly convergent thin plate portions 26 and 28, a pair of substantially vertical mid-height plate portions 30 and 32 and a pair of downwardly convergent plate portions 34 and 36, the lower ends of the plate portions 34 and 36 being joined and mounted rigid with a depending stem portion 38 including a pair of horizontally enlarged upper and lower abutments 40 and 42 which are spaced along the stem portion 38 and define opposing abutment surfaces 44 and 46. A vertically invertible handgrip 48 is secured to the stem portion 38 extending between the abutments 40 and 42 by removable threaded fasteners 50 and includes a reversely curving rearwardly opening recess 52 adjacent one end (the upper end as viewed in FIG. 2).

The lower window opening 24 is defined between pairs of opposite side plates 54, 56, 58 and 60 corresponding to the plates 26, 28, 34 and 36, the window opening 24 not including plates corresponding to the plates 30 and 32.

Each of the sight windows or openings 22 and 24, when disposed upper-most, defines an upwardly tapering sight window and an arrow rest referred to in general by the reference numeral 62 is mounted within the upper sight window 22. A corresponding arrow rest may be provided for the lower window 24 and will be of substantially the same construction, but of slightly different dimensions.

Figure 3:
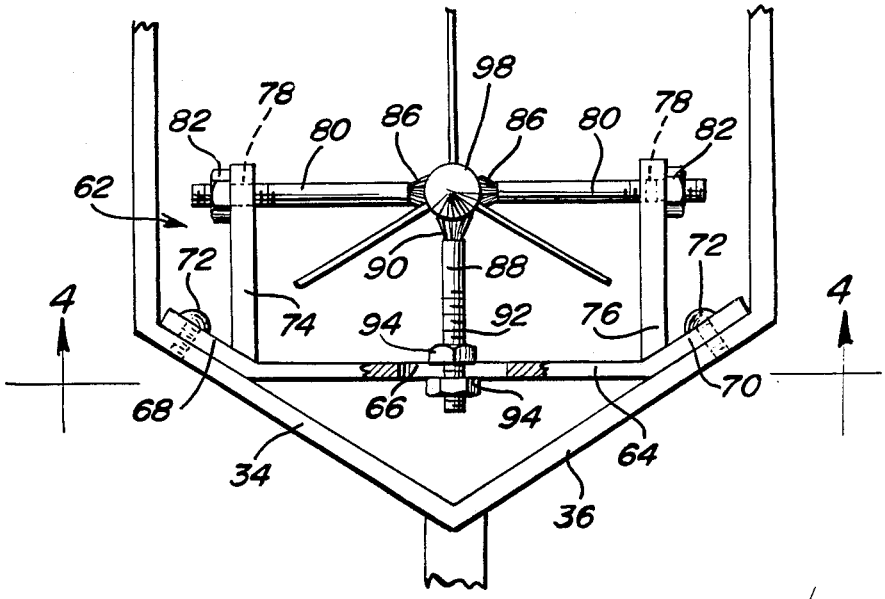
FIG. 3 is an enlarged fragmentary elevational view of the arrow rest with the components thereof in slightly altered adjusted position relative to each other.
Figure 4:
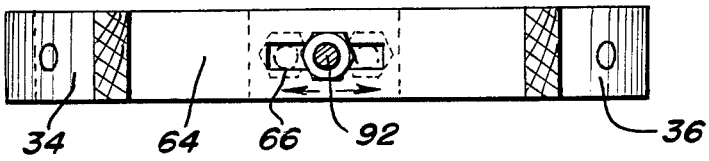
FIG. 4 is a horizontal sectional view taken substantially upon the plane indicated by the section line 4—4 of FIG. 3.
Figure 6:
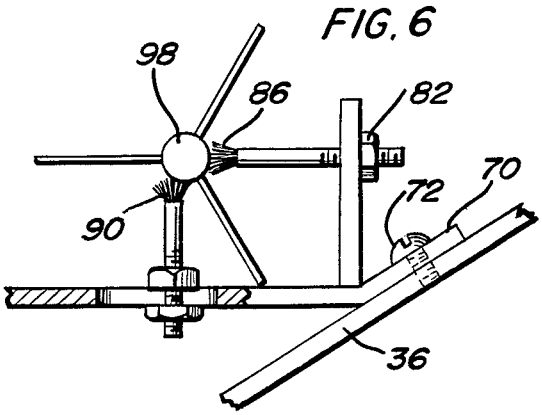
FIG. 6 is a fragmentary rear elevational view of the arrow rest structure illustrating a third manner of usage thereof.

The arrow rest 62 includes a lower horizontal base plate 64 including a mid-length longitudinal slot 66, see FIG. 3, and upwardly angled opposite ends 68 and 70 removably secured to the plates 34 and 36 by threaded fasteners 72. In addition, the opposite ends 68 and 70 include vertical uprights 74 and 76 projecting upwardly therefrom and the uprights include aligned upper end threaded bores 78 formed therethrough. The threaded base ends of a pair of longitudinally straight horizontal rest rods 80 are adjustably secured through the threaded bores 78 and locked in position relative thereto by lock nuts 82 and the rods 80 project toward each other and include tufts 86 of mohair projecting endwise outwardly of their adjacent ends. In addition, a center post or rod 88 including a tuft 90 of mohair on its upper end has its threaded lower end 92 secured through the slot 66 by lock nuts 94, the positioning of the rod 88 being adjusted longitudinally of the slot 66. When the rods 80 and 88 are adjusted as illustrated in FIG. 3, the fletched arrow shaft 98 is engaged by all three tufts 86 and 90. However, the arrow shaft 98 may be supportedly engaged by the right-hand tuft 86 and the tuft 90 as illustrated in FIG. 6 of the drawings if it is desired to position the arrow shaft 98 in a different rotated position. In this instance, the left-hand rod 80 is removed. However, the arrow shaft 98 may also be used in the angularly displaced position thereof illustrated in FIG. 3 if the left rod 80 is adjusted to the left in the manner illustrated in FIG. 2 of the drawings and the rod 88 is slightly shifted to the left in the slot 66.

Figure 5:
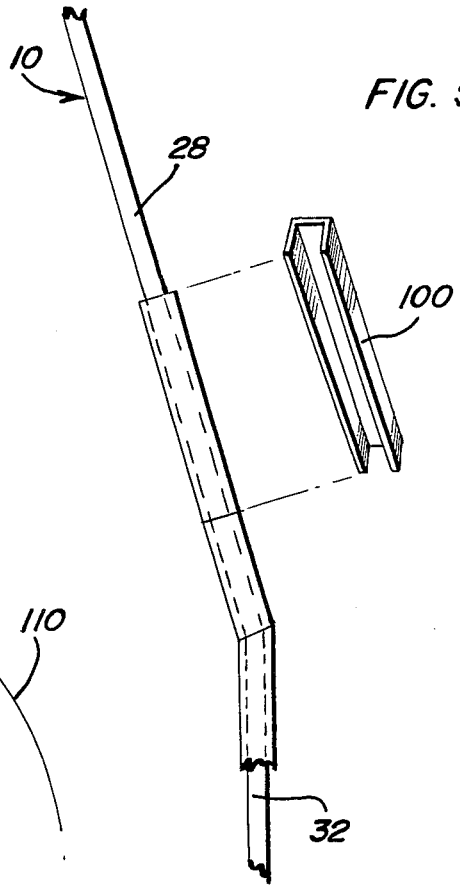
FIG. 5 is a fragmentary enlarged elevational view of the upper sight window structure of the bow illustrating the manner in which channel-shaped and specifically colored strips may be applied to the rear edges of the plate portions of the bow defining the sight window.

With attention invited more specifically to FIG. 5 of the drawings, it may be seen that the plate portions, such as plate portions 28 and 32, may have the rear edges thereof colored by variously covered channel-shaped trim strips 100, as deemed necessary or advantageous by the archer using the bow 10.

Further, when the upper sight window 22 is being utilized, the open front and rear ends of the lower sight window 24 may be closed by suitable closure panels (not shown) suitably removably anchored relative to the plates or plate portions 54, 56, 58 and 60 and the area defining the sight window 24 may be used as a storage compartment.

If the bow 10 comprises a compound bow, it will be necessary for one of the sight windows to be disposed uppermost when the bow is used by a right-handed archer and for the other sight window to be disposed uppermost when the bow is to be used by a left-handed archer. In this instance, the handgrip 48 is also inverted. Of course, if the sight window 24 is disposed uppermost, an arrow rest corresponding to the arrow rest 62 is mounted within the opening 24 in the same manner in which the arrow rest 62 is mounted within the opening 22.

Upon the assumption that the bow 10 is to be used primarily by either a right-handed person or a left-handed person and that the sight window or opening 22 is to be disposed uppermost, it will be noted that the handgrip 48 is positioned below the vertical mid-point of the mid-portion 12. Further, the vertical spacing between the abutment surface 44 and the arrow shaft 98 is approximately 2¼ inches. By placing the upper limit of the handgrip, defined by the abutment surface 44, 2¼ inches below the rest position of the arrow shaft 98, the arm by which the handgrip 48 is being held is in a slightly forwardly downwardly inclined position. It has been found that this positioning of the arm relieves considerable apparent stress on the shoulder and enables an archer to not only draw a stronger bow but to also effectively sight, either instinctively or mechanically, a bow having a greater pull.

With attention now invited more specifically to FIG. 2, the numeral 110 designates a target and it may be seen from FIG. 2 that not only the center portion of the target is viewable through the opening 22, but the remaining portion of the targert is viewable outside the plate portions 26, 28, 30, 32 and 34, 36. Also, the utilization of the arrow rest 62 as illustrated in FIG. 3 results in a fully balanced cast and "twisting torque" such as that caused by off-side windows is eliminated. Further, the lower end portions of the windows or sight openings 22 and 24 may be rounded, but the over all upwardly tapering configuration of the windows 22 and 24 is critical to the enhanced depth perception and visibility of the target 110.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bow with a depth perception and visibility enhancing sight window, said bow including a central, elongated and stiff mid-portion and a pair of elongated flexive limbs each including base and free ends, said base ends being mounted from opposite ends of said mid-portion with said free ends projecting substantially endwise outwardly from said opposite ends, at least one end of said mid-portion defining a sight window therethrough, said sight window, when the corresponding limb is disposed upright and uppermost, being vertically elongated and including generally straight upwardly convergent upper side marginal edges whose upper ends are spaced apart, generally straight downwardly convergent lower side marginal edges and generally straight, parallel upright mid-height side marginal edges extending between the corresponding upper and lower side marginal edges and defining a maximim width portion of said window therebetween, said lower side marginal edges, from the maximum width portion of said window, extending downwardly to the lowermost extremity of said window a vertical distance considerably less than said maximum width portion and said upper side marginal edges extending upwardly from said maximum width portion a vertical distance considerably greater than said maximum width portion, said mid-portion including a handgrip extending longitudinally thereof and spaced below said window, said bow including arrow rest means in said window defining a ready rest position for an arrow substantially tranversely centered in said maximum width portion and disposed at an elevation therein at least closely adjacent the lower extremity of said maximum width portion, the vertical elongation of said window and the gradual upward convergence of the upper side edges thereof above said rest providing an upper sight window portion of predetermined shape above the ready rest position which is appreciably greater in height than width thereby serving to enhance depth perception and visibility of a target viewed through said window, especially by an instinctive shooter, said upper sight window portion being free of obstructions therein which would destroy, visually, said predetermined shape of and clutter and obstruct an instinctive shooter's view through said upper sight window portion.

2. The bow of claim 1 wherein the arrow ready rest position defined by said arrow rest is disposed at an elevation approximately 2¼ inches above the upper extremity of said handgrip.

3. The bow of claim 2 wherein said arrow rest includes means for both laterally and vertically shifting said ready rest position in said window.

4. A bow with depth perception and visibility enhancing sight window, said bow including a central, elongated and stiff mid-portion and a pair of elongated flexive limbs each including base and free ends, said base ends being mounted from opposite ends of the said mid-portion with said free ends projecting substantially endwise outwardly from said opposite ends, at least one end of said mid-portion defining a sight window therethrough, said sight window, when the corresponding limb is disposed upright and uppermost, being vertically elongated and including upwardly convergent upper side marginal edges whose upper ends are spaced apart and downwardly convergent lower side marginal edges, said lower side marginal edges, from the maximum width portion of said window, extending downwardly to the lowermost extremity of said window a vertical distance considerably less than said maximum width portion and said upper side marginal edges extending upwardly from said maximum width portion a vertical distance considerably greater than said maximum width portion, said mid-portion including a handgrip extending longitudinally thereof and spaced below said window, said bow including arrow rest means in said window defining a ready rest postion for an arrow substantially transversely centered in said window and disposed at an elevation therein at least closely adjacent the elevation of said maximum width portion, the vertical elongation of said window and the gradual upward convergence of the upper side edges thereof above said rest serving to enhance depth perception and visibility of a target viewed through said window, especially by an instinctive shooter, said mid-portion including a horizontally outwardly projecting enlargement defining a downwardly facing abutment surface establishing an upper limit position of a shooter's hand grasping said handgrip, the other end of said mid-portion also defining a sight window therethrough and the corresponding end of said handgrip including a second outwardly projecting enlargement defining an abutment surface opposing the first mentioned abutment surface and defining a limit position of a shooter's hand grasping said handgrip against shifting toward the last mentioned window.

5. The bow of claim 4 wherein the first mentioned abutment surface is spaced generally 2¼ inches below said ready rest position.

6. The bow of claim 4 wherein said handgrip is disposed, totally, below the vertical mid-portion of said central, elongated and stiff mid-portion, said mid-portion being centered between the free ends of said limbs.

7. The bow of claim 4, wherein there are mid-height extremities merging smoothly into the lower extremities of said upper side marginal edges and merging smoothly into the upper extremities of said lower side marginal edges.

8. The bow of claim 4 wherein said mid-portion includes from and rear sides, the rear side of said handgrip including a rearwardly opening smoothly reversely curved notch immediately beneath said abutment surface.

9. In an archery bow including a central, elongated and stiff mid-portion and a pair of elongated flexible limbs each including base and free ends with said base ends being mounted from opposite ends of said mid-portion and said free ends projecting substantially endwise outwardly from said opposite ends, a handgrip defined on said mid-portion on one side of the longitudinal center of said mid-portion and a sight window defined in said mid-portion on the other side of the longitudinal center of said mid-portion, said sight window including an upper portion defined by generally straight upper opposite side and upwardly convergent thin front-to-rear extending plate portions with the upper ends of said plate portions spaced laterally apart, said sight window including a lower portion defined between generally straight opposite side lower front-to-rear extending and downwardly convergent plate portions and a mid-height portion defined by generally straight opposite side upright, parallel plate portions extending between the lower and upper extremities of corresponding upper and lower plate portions, an arrow rest in said window defining an arrow ready rest position for an arrow substantially transversely centered in said window and at an elevation therein above and at least closely adjacent the elevation of the upper extremities of said lower plate portions, said plate portions being generally $\frac{1}{8}$ to $\frac{1}{4}$ inch in thickness, said arrow ready rest position defined by said arrow rest being disposed at an elevation approximately $2\frac{1}{4}$ inches above the upper extremity of said handgrip, said arrow rest including means for both laterally and vertically shifting said ready rest position in said window, said arrow rest including a central vertical post equipped with a hair tuft at its upper end and at least one horizontal transverse rod including an inner end equipped with a hair tuft spaced slightly laterally of the center of said post and an outer end supported for adjustable longitudinal shifting of said rod.

10. The bow of claim 9 wherein said rest includes an additional horizontal rod on the side of said post remote from the first mentioned rod and including an inner end equipped with a hair tuft and an outer end mounted for adjustable longitudinal shifting of the last mentioned rod, the center lines of said rods being spaced slightly above said hair tuft carried by said post.

11. The bow of claim 10 including means mounting said central vertical post from said bow for adjustable lateral shifting relative thereto.

* * * * *